US006749543B2

(12) United States Patent
McLaughlin

(10) Patent No.: US 6,749,543 B2
(45) Date of Patent: Jun. 15, 2004

(54) WHEEL RESISTANCE EXERCISE DEVICE

(76) Inventor: Gary McLaughlin, 13300 Wingo St., Arleta, CA (US) 91331

( * ) Notice: Subject to any disclaimer, the term of this patent is extended or adjusted under 35 U.S.C. 154(b) by 53 days.

(21) Appl. No.: 09/971,178

(22) Filed: Oct. 4, 2001

(65) Prior Publication Data

US 2003/0069111 A1 Apr. 10, 2003

(51) Int. Cl.[7] ..... A63B 69/16
(52) U.S. Cl. ..... 482/57; 482/60; 482/74
(58) Field of Search ..... 482/51–65, 605, 482/74, 68, 93, 98, 70

(56) References Cited

U.S. PATENT DOCUMENTS 3,192,772 A * 7/1965 Tarter ..... 73/379.07
4,206,914 A * 6/1980 Lee ..... 482/65
4,364,557 A * 12/1982 Serati ..... 482/65
4,867,439 A * 9/1989 Salyer ..... 482/68
5,810,697 A * 9/1998 Joiner ..... 482/68

* cited by examiner

*Primary Examiner*—Nicholas D. Lucchesi

*Assistant Examiner*—Tam Nguyen

(74) *Attorney, Agent, or Firm*—Lawrence S. Cohen

(57) ABSTRACT

An exercise device to be pushed by the user having a frame with handle bars and a fork carrying a road wheel and an adjustable resistance mechanism including a small resistance wheel that can contact the road wheel with relatively greater or lesser force to cause more or less resistance rotation of the road wheel.

5 Claims, 3 Drawing Sheets

WHEEL RESISTANCE EXERCISE DEVICE

FIELD OF THE INVENTION

The invention relates to wheeled exercise devices.

BACKGROUND

There are various wheel resistance devices, known as stationary bicycles, for exercise in which the user sits on the device and operates pedals against a resistance mechanism.

There are also resistance devices which allow the user to walk or run while pushing the device and which use various means to impose load or resistance to increase the effort required to push or pull the device.

DETAILED DESCRIPTION

Figure 1:
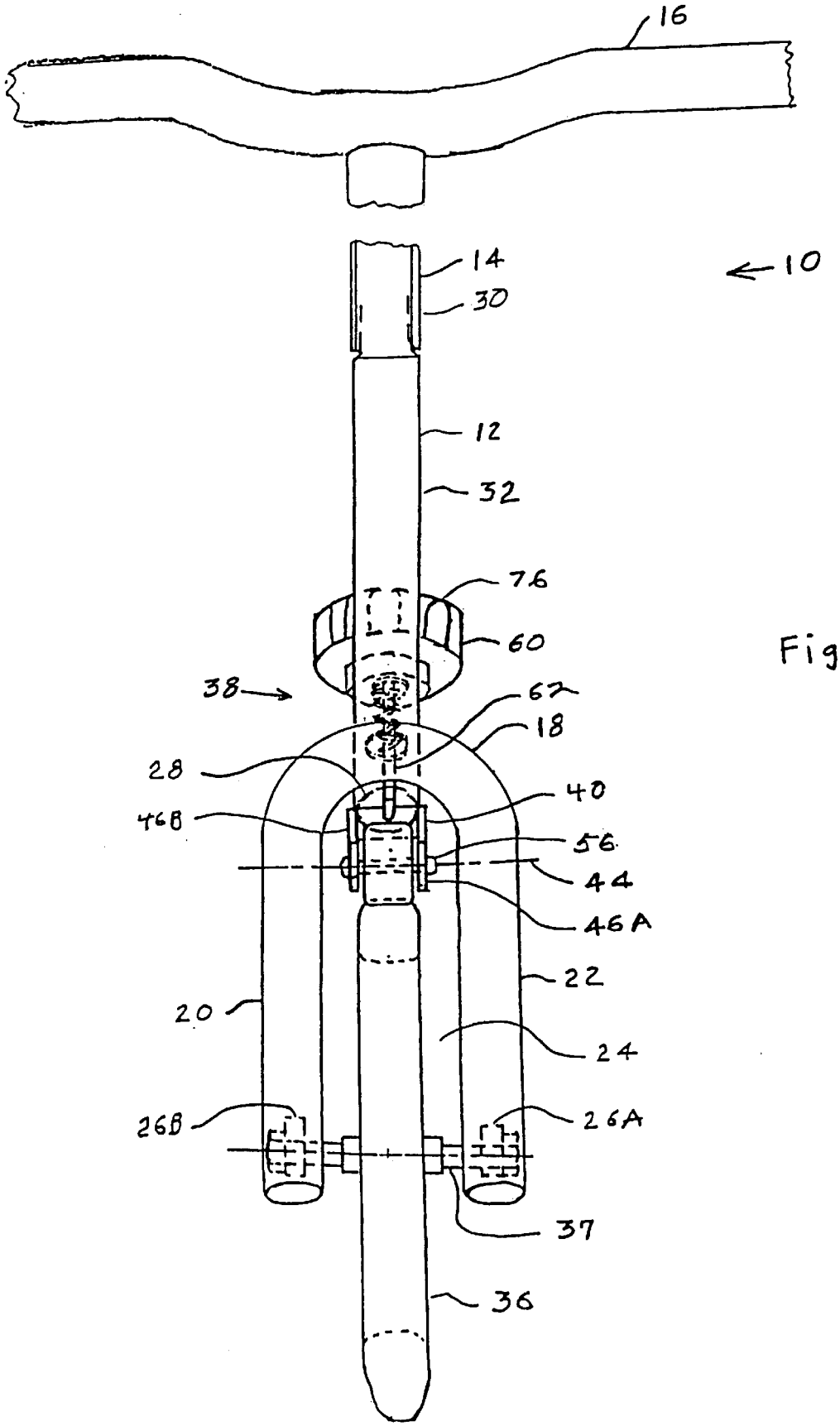
FIG. 1 is a front view of the invention.
Figure 2:
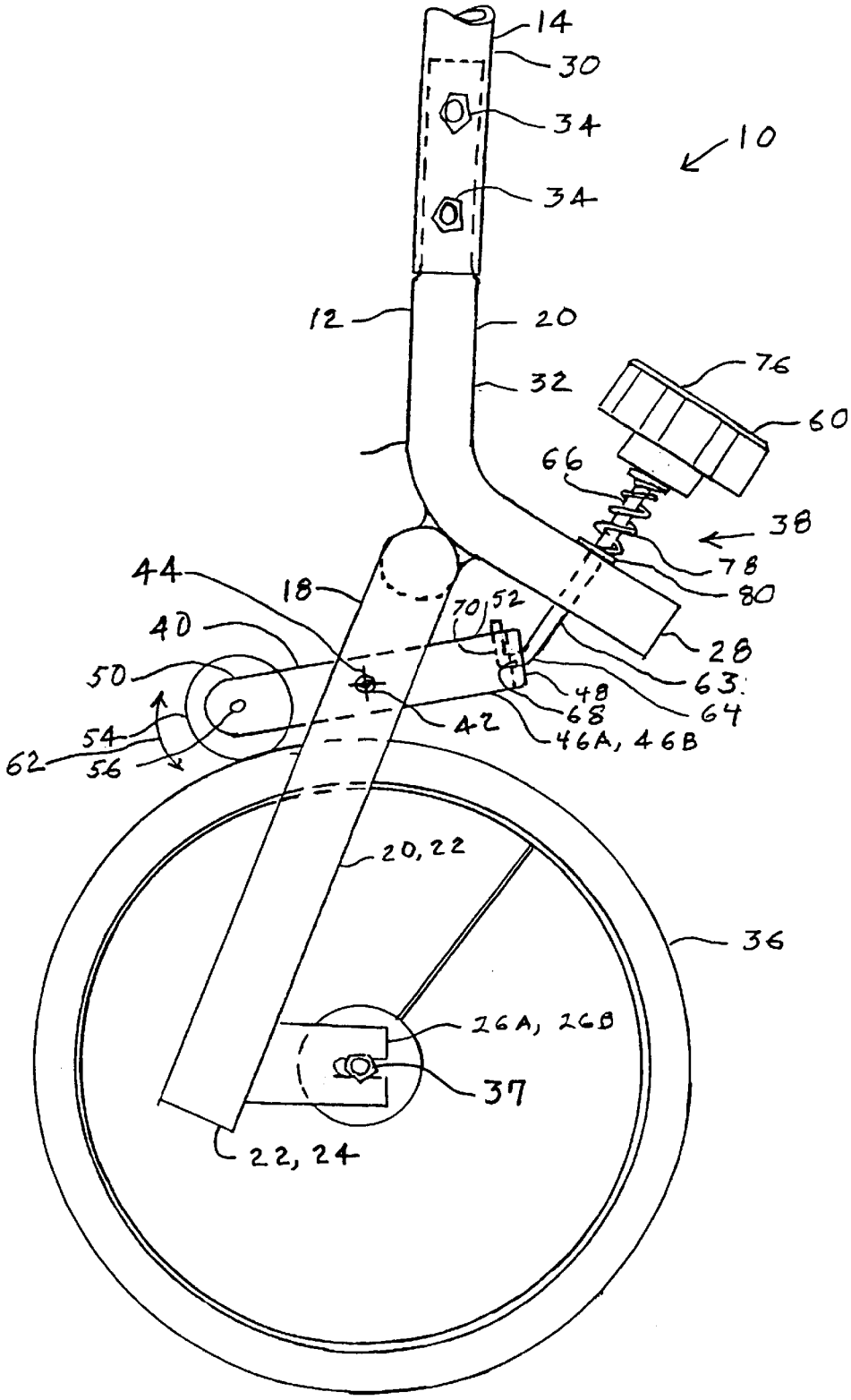
FIG. 2 is a partial side view of the invention.

Referring to FIGS. 1 and 2, the exercise device 10 has a frame 12 consisting of a frame shaft 14, at the top of which is a handle bar 16, and having attached at its bottom a wheel fork 18, having wheel fork legs 20 and 22, defining between them a wheel space 24, and terminating in wheel supports 26A and 26B. The frame 12 has a tube extension portion 28. In this particular embodiment, the frame 12 consists of an upper frame shaft portion 30, and a lower frame shaft portion 32, which are joined together by bolts 34. A wheel and tire assembly 36 is located in the wheel space 24 and is rotatably attached to the wheel supports 26A and 26B by an axle assembly 37. This entire structure is similar to the assembly structure of a common bicycle frame front portion, handle bars, forks and wheels. The wheel assembly of a bicycle can be used.

The tube extension portion 28 of the frame 12 is adapted to hold an adjustable resistance assembly 38, which is designed to cause a resistance wheel to bear on the wheel and tire assembly 36 and is adjustable to increase or decrease the bearing pressure on the wheel and tire assembly 36.

In the preferred embodiment of the resistance assembly 38, a lever 40 is pivotally attached between the wheel fork legs 20 and 22 by a pin or bolt 42, which defines a pivot axis 44 for the lever 40. In this embodiment the lever 40 is formed by a pair of spaced-apart opposed arms 46A and 46B connected by a brace 48. The lever 40 has a first end 50 which is forward of the pivot axis 44 and a second end 52 which is rearward of the pivot point. Attached to the first end 50 of the lever 40 is a small resistance wheel 54 rotatable on a bearing pin 56 mounted through the opposed arms 46A, 46B.

Attached at the second end 52 as part of the adjustable resistance assembly is an adjusting mechanism 60 which adjustably pivots the lever 40 on the pivot axis 44 to cause the resistance wheel 54 to pivot as shown by arrow 62.

The adjusting mechanism 60 has an adjusting link 63 having a lower end 64 and an upper end 66. The lower end 64 enters the hole 68 in the brace 48 and is bent upward at 70 to be fixed in place. The upper end 66 is threaded (not shown). The adjusting link 62 passes through the tube extension portion 28 and has a threaded knob 76 threaded onto the threads at the upper end 66. A spring 78 is fitted between the threaded knob 76 and the tube extension portion 28 and is constructed so as to be in a compressed condition for most of the useful travel of the knob 76 so as to keep the knob 76 from turning by itself. A washer 80 is helpful.

Figure 3:
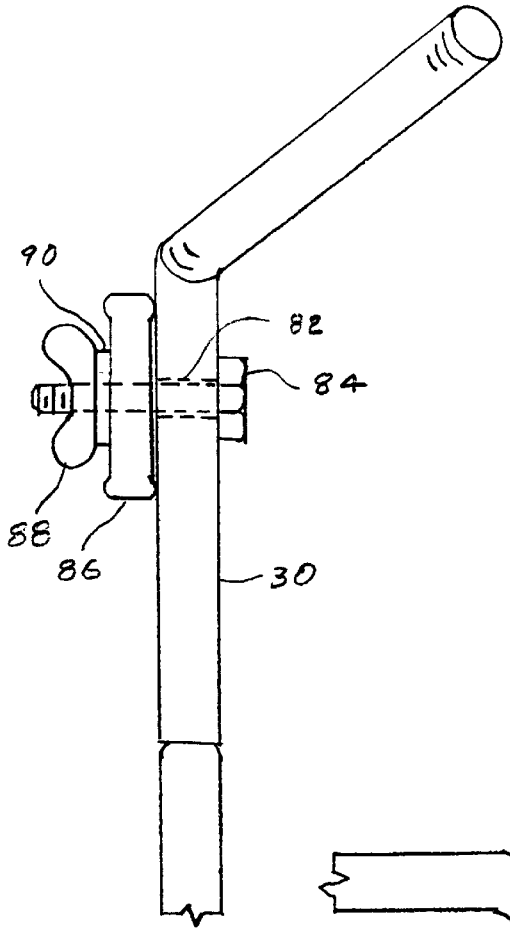
FIG. 3 is a partial side view showing a feature of the invention.
Figure 4:
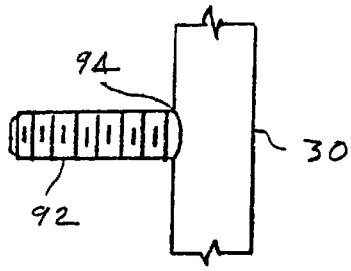
FIG. 4 is a side view of a detail of the invention.
Figure 5:
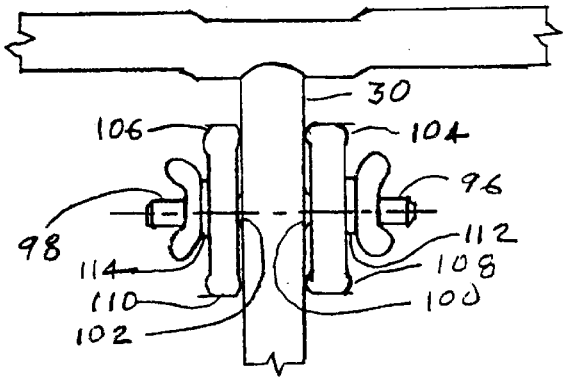
FIG. 5 is a partial side view showing a feature of the invention.

An additional exercise variable can be obtained by providing means to attach free weights to the devise. One means for doing this is shown in FIG. 3. As shown, the upper frame shaft portion 30 has a hole 82 extending through it. A bolt 84 is in place through the hole and a weight 86 is mounted on the bolt 84. In this example, the weight 86 is retained by a wing nut 88 threaded onto the bolt 84 along with a washer 90. FIG. 4 shows another means for mounting a weight in which a threaded rod 92 is welded to the shaft 30 at 94. In another embodiment a clamp devise could be configured with a rod or bolt attached, in which the position of the clamp can be adjusted, up or down on the shaft. Other forms could include all of the above means in which a pin or bolt extends sideways of the shaft, to each side, allowing a weight to be mounted on each side of the shaft. An example of this is shown in FIG. 5 in which the shaft 30 has rods 96, 98 extending oppositely to each side. The rods 96, 98 can be welded as at 100, 102 to the shaft 30. In this configuration, weights 104, 106 can be oppositely mounted on the respective rods 100, 102, held by wing nuts 108, 110 and washers 112, 114.

In use, the upper shaft portion 30 is assembled to the lower shaft portion 32. The knob 76 is adjusted to pivot the lever 40 to cause the resistance wheel 54 to bear on the tire 36 to a pressure as desired. Greater pressure will cause more resistance to turning of the tire 36. To obtain exercise the user takes a position behind the device after adjusting the knob 76 to create the desired resistance. Then the user pushes the handlebars ahead of himself or herself to cause the tire 36 to turn. The tire 36 will turn with greater or lesser required pushing force depending on the setting of the knob 76.

If the knob 76 is set so that resistance wheel 54 provides little or no resistance to turning of tire 36, then the device can be pushed easily ahead of the user. But, as more resistance is placed on tire 36, more effort will be required to push the device. In general, as the required force increases, more effort will be required to push the device. In general, as the required force increases the user will tilt the frame 12 to angle the tire 36 further away, but preferably not more than 45°.

Also, to change the muscles exercised, the shaft 14 may be tilted less and its user uses his or her arms to push downward on the shaft 14 to overcome the resistance, preventing the tire 36 from skidding.

Of course "cheating" by letting its tire 36 skid along the ground is self-defeating. If this happens, either greater downward pressure is exerted, or a sharper angle is created, or both.

The resistance can be adjusted according to a set plan such as, less resistance for warm-up or aerobic exercise and more resistance for muscle building such as by pushing through the legs and arms.

Although particular embodiments of the invention have been described and illustrated herein, it is recognized that modifications and variations may readily occur to those skilled in the art and consequently it is intended that the claims be interpreted to cover such modifications and equivalents.

What is claimed is:

1. An exercise apparatus for pushing along the ground by a user comprising:

a frame having handle bars at an upper end for gripping by the user in order to push the apparatus along the ground and a wheel supporting portion at a lower end;

a single ground contactable wheel rotatably mounted on the wheel supporting portion and able to contact the ground for rotation along the ground by a user pushing the apparatus;

a pivot arm pivotally attached to the frame near the single ground contactable wheel and having a first end and a second end, the first end extending near the single ground contactable wheel and the second end extending away from the single ground contactable wheel;

a resistance wheel rotatably attached to the first end for contact with the single ground contactable wheel; and an adjustment mechanism attached to the second end such that the adjustment mechanism can move the second end up or down to cause the first end to move up or down respectively and thereby cause the resistance wheel to come into contact with the single ground contactable wheel with greater or lesser force to cause more or less resistance to rotation of the single ground contactable wheel.

2. An exercise apparatus for pushing along the ground by a user comprising:

a frame having handle bars at an upper end for gripping by the user in order to push the apparatus along the ground and a wheel supporting portion at a lower end;

a single ground contactable wheel rotatably mounted on the wheel supporting portion and able to contact the ground for rotation along the ground by a user pushing the apparatus;

a pivot arm pivotally attached to the frame near the single ground contactable wheel and having a first end and a second end, the first end extending near the single ground contactable wheel and the second end extending away from the single ground contactable wheel;

a resistance wheel rotatably attached to the first end for contact with the single ground contactable wheel;

an adjustment mechanism attached to the second end such that the adjustment mechanism can move the second end up or down to cause the first end to move up or down respectively and thereby cause the resistance wheel to come into contact with the single ground contactable wheel with greater or lesser force to cause more or less resistance to rotation of the single ground contactable wheel;

an elongate member extending from the frame; and at least one weight removably supported on the elongate member.

3. An exercise apparatus for pushing along the ground by a user comprising:

a frame having a handle portion at an upper end for gripping by the user in order to push the apparatus along the ground and a wheel supporting portion at a lower end;

a single ground contactable wheel rotatably mounted on the wheel supporting portion and able to contact the ground for rotation along the ground by a user pushing the apparatus; and a resistance adjusting mechanism having a resistance wheel bearing on the single ground contactable wheel and a mechanism for adjusting the force of the resistance wheel on the single ground contactable wheel.

4. The exercise apparatus of claim 3 wherein the frame is comprised of two parts, an upper part having a handle bar for gripping by the user in order to push the apparatus along the ground and a lower part having the wheel supporting portion; and means to join the upper part and the lower part.

5. The exercise apparatus of claim 3 further comprising at least one weight removably attached to the frame.

* * * * *

UNITED STATES PATENT AND TRADEMARK OFFICE

CERTIFICATE OF CORRECTION

PATENT NO. : 6,749,543 B2
APPLICATION NO. : 09/971178
DATED : June 15, 2004
INVENTOR(S) : Gary McLaughlin It is certified that error appears in the above-identified patent and that said Letters Patent is hereby corrected as shown below:

Column 2, Line 1
The adjusting link [62] 63 passes through the tube

Signed and Sealed this

First Day of July, 2008

JON W. DUDAS
*Director of the United States Patent and Trademark Office*